US011355836B2

(12) United States Patent
Johansson et al.

(10) Patent No.: US 11,355,836 B2
(45) Date of Patent: Jun. 7, 2022

(54) COMBINED ANTENNA AND RADOME ARRANGEMENT

(71) Applicant: Telefonaktiebolaget LM Ericsson (publ), Stockholm (SE)

(72) Inventors: Stefan Johansson, Romelanda (SE); Livia Cerullo, Gothenburg (SE); Lars Persson, Åsa (SE); Mikael Pohlman, Gothenburg (SE); Torbjörn Westin, Partille (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 683 days.

(21) Appl. No.: 16/323,998

(22) PCT Filed: Jan. 18, 2019

(86) PCT No.: PCT/EP2019/051215
§ 371 (c)(1),
(2) Date: Feb. 7, 2019

(87) PCT Pub. No.: WO2020/147960
PCT Pub. Date: Jul. 23, 2020

(65) Prior Publication Data

US 2021/0384621 A1 Dec. 9, 2021

(51) Int. Cl.
*H01Q 1/42* (2006.01)
*H01Q 1/24* (2006.01)

(52) U.S. Cl.
CPC ..... *H01Q 1/422* (2013.01); *H01Q 1/246* (2013.01)

(58) Field of Classification Search
CPC ..... H01Q 1/246; H01Q 1/422
See application file for complete search history.

(56) References Cited

U.S. PATENT DOCUMENTS 4,783,666 A 11/1988 Ast et al.
5,408,244 A * 4/1995 Mackenzie ..... H01Q 1/422 343/872

(Continued)

FOREIGN PATENT DOCUMENTS

EP 2 916 387 A1 9/2015

OTHER PUBLICATIONS

International Search Report and Written Opinion dated Sep. 4, 2019 issued in International Application No. PCT/EP2019/051215. (16 pages).

*Primary Examiner* — Lam T Mai
(74) *Attorney, Agent, or Firm* — Rothwell, Figg, Ernst & Manbeck, P.C.

(57) ABSTRACT

There is provided a combined antenna and radome arrangement. The combined antenna and radome arrangement comprises an advanced antenna system (AAS). The AAS comprises antenna elements and is configured for communication in a frequency range of 2.5 GHz to 10 GHz. The combined antenna and radome arrangement further comprises a radome. The radome has a first layer sandwiched between two second layers. The two second layers are of a second dielectric material. The first layer is of a first dielectric material and has a thickness $t_1$, where $t_1 \leq \lambda_{min}/3$, wherein $\lambda_{min}$ is the wavelength of the highest frequency in the frequency range of the AAS. The radome is placed in front of the AAS such that the radome forms a cover for the AAS.

20 Claims, 7 Drawing Sheets

(56) References Cited

U.S. PATENT DOCUMENTS

| | | | | |
|---|---|---|---|---|
| 6,028,565 | A * | 2/2000 | Mackenzie | H01Q 1/422 343/872 |
| 6,323,825 | B1 * | 11/2001 | Zidek | H01Q 1/422 343/753 |
| 7,151,504 | B1 * | 12/2006 | Boatman | H01Q 1/422 343/872 |
| 2002/0014992 | A1 * | 2/2002 | Sun | H01Q 9/0407 343/700 MS |
| 2010/0039346 | A1 | 2/2010 | Peter et al. | |
| 2010/0103072 | A1 * | 4/2010 | Wu | H01Q 1/002 343/872 |
| 2013/0009846 | A1 * | 1/2013 | Freitag | H01Q 1/281 343/872 |
| 2014/0302807 | A1 * | 10/2014 | Lee | H01Q 21/065 455/272 |
| 2015/0004423 | A1 | 1/2015 | Cheon et al. | |
| 2015/0236421 | A1 * | 8/2015 | Zemliakov | H01Q 9/045 343/700 MS |
| 2018/0097288 | A1 * | 4/2018 | DiDomenico | G05D 1/0094 |
| 2018/0294561 | A1 * | 10/2018 | Hayes | H01Q 19/06 |
| 2019/0103668 | A1 * | 4/2019 | Stressing | B32B 7/12 |
| 2020/0212556 | A1 * | 7/2020 | Moore | B32B 5/02 |
| 2021/0175617 | A1 * | 6/2021 | Chen | H01Q 1/246 |

* cited by examiner

COMBINED ANTENNA AND RADOME ARRANGEMENT

CROSS REFERENCE TO RELATED APPLICATION(S)

This application is a 35 U.S.C. § 371 National Stage of International Patent Application No. PCT/EP2019/051215, filed Jan. 18, 2019, designating the United States.

TECHNICAL FIELD

Embodiments presented herein relate to a combined antenna and radome arrangement.

BACKGROUND

In general terms, previously unused frequency bands either have been released or are to be released in the frequency range 3-10 GHz for fifth generation (5G) mobile communication systems. The legacy frequency bands used for second generation (2G) to fourth generations (4G) mobile communication systems are today predominately in the frequency range 0.6-2.7 GHz. Hence, new antenna systems need to be developed including the new frequency bands and by that also suitable antenna radomes.

In general terms, the radome has basically the function to give environmental protection to the antenna equipment while at the same time being transparent for electromagnetic radiation. The latter means that the radome should have transparency and reflectivity with respect to radio frequency (RF) propagation waves that gives a minimal impact on the radiation performance of the antenna equipment protected by the radome. Since the radome to a large extent sets the visual impression of the antenna system product comprising the antenna equipment, the radome is commonly developed as part of an industrial design process.

For 5G mobile communication systems, advanced antenna system (AAS), sometimes also referred to as an active antenna system, is one component to improve capacity and coverage, with respect to 2G-4G mobile communication systems, by making use of the spatial domain. In this respect, dynamic beamforming as enabled by AAS might impose harder requirements on the transparency and reflectivity of the radome with respect to RF propagation waves. One reason for this is that for typical legacy (i.e., non-AAS) antenna systems adapted for transmission and reception in a few fixed beams there is a possibility to, to some extent, compensate for the RF shortcomings of the radome by a thorough joint design of the antenna system and the radome. This possibility is much more limited for AAS since AAS should be able to operate using a much larger quantity of different beams for transmission and reception.

There are basically three types of radomes used for environmental protection; radomes that are electrically thin in terms of the wavelength (such as having a thickness of a fraction of the wavelength) at which the antenna system is intended to operate at; tuned solid radomes with an electrical thickness of half the wavelength (or a multiple thereof); and tuned sandwich radomes with an electrical thickness of a quarter of the wavelength (or an odd multiple thereof).

The radomes currently used for mobile communication antennas are solid radomes consisting of, for example, polycarbonate or polyester/glass fiber with a permittivity $\varepsilon_r$, or dielectric constant in the range of $3 \leq \varepsilon_r \leq 4.5$. The thickness is commonly in the order of 2 mm to 4 mm. This means that electrically thin radomes are used, i.e. having an electrical thickness in the order of 0.05 wavelengths or less.

FIG. 1 shows the predicted transmission and reflections properties for a typical solid radome with a thickness of 3 mm as a function of frequency and illumination angle. At (a) and (b) are shown the results for an incident field with a polarization perpendicular to the plane of incidence while at (c) and (d) are shown the results for a polarization parallel to the plane of incidence. At (a) and (c) are shown the reflection properties and at (b) and (d) are shown the transmission properties of the radome.

A radome that in practice can be assumed to have negligible impact on an antenna system for mobile communication should have transmission losses predominately in the order of 0.2 dB to 0.3 dB or less and a reflectivity of predominately in the order of −15 dB to −20 dB or less. Higher amounts of reflected power will partly result in a mismatch of the antenna system and this reflected power will be re-scattered from the antenna system and by that interfere with the desired radiation performance.

It is clear from FIG. 1 that for frequency above 3 GHz this typical radome cannot be assumed to have negligible impact on the radiation performance. A possibility is to make the radome thinner, but a radome thinner than 2 mm will have difficulties in terms of handling mechanical requirements as well as being challenging to manufacture. There is also a possibility to some extent compensate RF shortcomings of the radome by a thorough joint design of the antenna system and the radome together. However, such a joint design might be challenging to achieve and might still not result in the RF shortcomings being fully compensated for.

In view of the above, there is still a need for improved radomes for AASs.

SUMMARY

An object of embodiments herein is to provide a radome suitable for AASs where the radome does not suffer from the above issues, or at least where the above issues have been mitigated or reduced.

According to a first aspect there is presented a combined antenna and radome arrangement. The combined antenna and radome arrangement comprises an advanced antenna system (AAS). The AAS comprises antenna elements and is configured for communication in a frequency range of 2.5 GHz to 10 GHz. The combined antenna and radome arrangement further comprises a radome. The radome has a first layer sandwiched between two second layers. The two second layers are of a second dielectric material. The first layer is of a first dielectric material and has a thickness $t_1$, where $t_1 \leq \lambda_{min}/3$, wherein $\lambda_{min}$ is the wavelength of the highest frequency in the frequency range of the AAS. The radome is placed in front of the AAS such that the radome forms a cover for the AAS.

Advantageously this radome does not suffer from the above issues.

Advantageously this radome has a negligible impact on the RF-radiation performance of the AAS, i.e. the radiation performance can in practice be assumed to be the same as without the radome.

According to a second aspect there is presented a combined antenna and radome arrangement according to the first aspect that further comprises a non-advanced antenna system (non-AAS). The non-AAS comprises antenna elements and is configured for communication in a frequency range of 0.6-2.7 GHz. The radome is placed in front of the non-AAS such that the radome forms a common cover for the AAS and the non-AAS.

Advantageously this allows both the AAS and the non-AAS to be covered by one and the same radome and hence could alleviate the need for separate radomes for the 3*o* AAS and the non-AAS.

Advantageously this radome has a negligible impact on the RF-radiation performance of the AAS as well as the non-AAS, i.e. the radiation performance can in practice be assumed to be the same as without the radome.

Advantageously this radome can be used with an off-the-shelf passive antenna system together with an AAS.

Advantageously the combined antenna and radome arrangement is modular and flexible in terms of a variety of combinations of off-the-shelf passive antenna system and off-the-shelf AAS.

Other objectives, features and advantages of the enclosed embodiments will be apparent from the following detailed disclosure, from the attached dependent claims as well as from the drawings.

Generally, all terms used in the claims are to be interpreted according to their ordinary meaning in the technical field, unless explicitly defined otherwise herein. All references to "a/an/the element, apparatus, component, means, module, step, etc." are to be interpreted openly as referring to at least one instance of the element, apparatus, component, means, module, step, etc., unless explicitly stated otherwise. The steps of any method disclosed herein do not have to be performed in the exact order disclosed, unless explicitly stated.

BRIEF DESCRIPTION OF THE DRAWINGS

The inventive concept is now described, by way of example, with reference to the accompanying drawings, in which.

DETAILED DESCRIPTION

The inventive concept will now be described more fully hereinafter with reference to the accompanying drawings, in which certain embodiments of the inventive concept are shown. This inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description. Any step or feature illustrated by dashed lines should be regarded as optional.

As disclosed above there is a need for improved radomes for AASs. Some of the embodiments disclosed herein therefore relate to a radome concept for mobile communication sites having antenna system configured to operate in the frequency range of 3 GHz to 10 GHz.

To accomplish this, there is a stringent requirement on that the radome having negligible impact on the performance of the antenna system covered by the radome. If this is not the case, the antenna systems cannot be assumed to have the same performance as without the radome. This can to some extent be handled by re-verifying and re-defining product performance with the radome in place. However, this would impact the flexibility and modularity of the combined antenna and radome arrangement.

Figure 2:
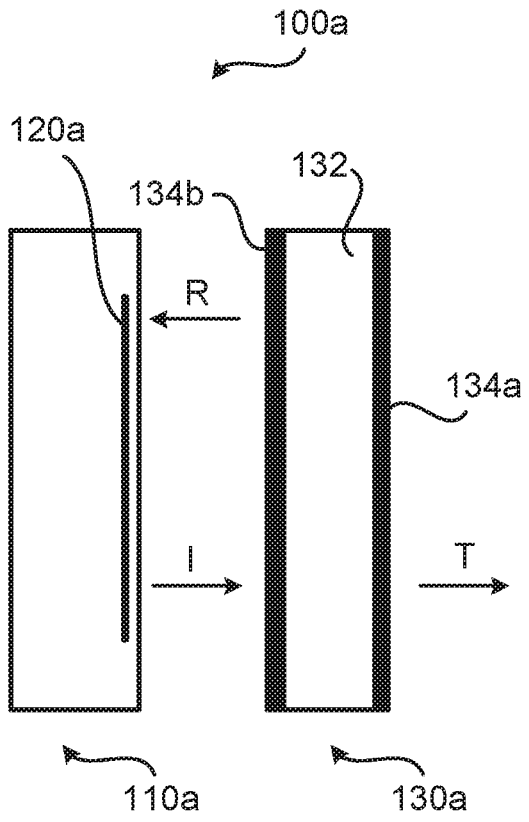
FIG. 2 schematically illustrates a combined antenna and radome arrangement according to an embodiment.

Reference is now made to FIG. 2 that schematically illustrates a combined antenna and radome arrangement 100*a* according to an embodiment, not drawn to scale. In FIG. 2, "R" is short for reflectance, "T" is short for transmission, and "I" is short for incident field and denotes radiated emission/reception of radio waves.

The combined antenna and radome arrangement 100*a* comprises an advanced antenna system (AAS) 110*a*. In turn, the AAS 110*a* comprises antenna elements 120*a*. The AAS 110*a* is configured for communication in a frequency range of 2.5 GHz to 10 GHz. In some examples the AAS 110*a* only is to operate in a subrange of this frequency range.

The combined antenna and radome arrangement 100*a* further comprises a radome 130*a*. The radome 130*a* is placed in front of the AAS 110*a* such that the radome 130*a* forms a cover for the AAS 110*a*.

In some aspects the radome 130*a* is of a broadband untuned sandwich design, comprising two outer skins (hereinafter denoted second layers) having a core (hereinafter denoted first layer) there in between. In particular, the radome 130*a* has a first layer 132 and two second layers 134*a*, 134*b*.

The first layer 132 has a thickness $t_1$, where $t_1 \leq \lambda_{min}/3$, wherein $\lambda_{min}$ is the wavelength of the highest frequency in the frequency range of the AAS 110*a*. When the AAS 110*a* only is to operate in a subrange of the frequency range, the highest frequency might be the highest frequency of the subrange.

The first layer 132 is of a first dielectric material. The first layer 132 is sandwiched between the two second layers 134*a*, 134*b*. The two second layers 134*a*, 134*b* are of a second dielectric material. According to this sandwich design, the radome 130*a* thus comprises at least three layers.

Further aspects, embodiments, and examples of the radome 130*a* will be disclosed below.

The radome 130*a* according to the above has a negligible impact on the RF-radiation performance of the AAS 110*a*. That is, the radiation performance of the AAS 110*a* can in practice be assumed to be the same as without the radome 130*a*.

Using a sandwich design for the radome 130*a* gives the combined benefit of attractive RF performance and mechanical strength.

Embodiments relating to further details of the combined antenna and radome arrangement 100*a*, 100*b* will now be disclosed.

In some aspects the radome 130*a* is placed in front of the AAS 110*a* such that one of the second layers 134*a*, 134*b* faces the antenna elements 120*a* of the AAS 110*a*. In the illustrative example of FIG. 2 the second layer 134*b* faces the antenna elements 120*a* of the AAS 110*a*.

Aspects of the first layer 132 will now be disclosed.

As disclosed above, the first layer 132 has a thickness $t_1$, where $t_1 \leq \lambda_{min}/3$. In some aspects the first layer 132 is even thinner. For example, according to an embodiment, $t_1 \leq \lambda_{min}/$ 4. Further in this respect there might be a minimum thickness of the first layer 132. For example, according to an embodiment, $t_1>1.5$ mm.

As disclosed above, the first layer 132 is of a first dielectric material. There might be different kinds of such first dielectric materials. In some aspects the first dielectric material is defined by its permittivity $\varepsilon_{r,1}$. In some aspects the first layer 132 is of a material having low permittivity to achieve attractive electrical characteristics (such as low reflectivity and loss) for the radome 130*a*. In this respect the first dielectric material might have a permittivity $\varepsilon_{r,1}$, where $1\leq\varepsilon_{r,1}\leq1.5$. Preferably, $1.05\leq\varepsilon_{r,1}\leq1.2$.

As an example, the first dielectric material could be a solid foam with closed or open cells, such as a PolyMethacrylImide (PMI) foam.

Additionally, or alternatively to using a PMI foam, there might be a support structure sandwiched between the second layer 134*a*, 134*b*. Particularly, according to an embodiment, the radome 130*a* further comprises a support structure disposed in the in the first layer 132. Using a support structure could result in a glass fiber reinforced polymer sandwich construction for the radome 130*a*. There could be different types of support structures. According to some examples the support structure has the geometry of a honeycomb. The radome 130*a* might thus have a honeycomb core defining the first layer 132.

Aspects of the second layers 134*a*, 134*b* will now be disclosed.

In general terms, each second layer 134*a*, 134*b* has a thickness $t_{2,1}$, $t_{2,2}$. That is, the second layer 134*a* has a thickness $t_{2,1}$ and the second layer 134*b* has a thickness $t_{2,2}$. According to an embodiment each second layer 134*a*, 134*b* has a thickness $t_{2,1}$, $t_{2,2}$ in the range 0.1 mm to 0.5 mm. That is, according to an embodiment, 0.1 mm$\leq t_{2,1}$, $t_{2,2}\leq$0.5 mm.

In some aspects both second layers 134*a*, 134*b* are of the same thickness, that is $t_{2,1}=t_{2,2}$. However, in other aspects the second layers 134*a*, 134*b* are not of the same thickness, that is $t_{2,1}\neq t_{2,2}$. In this respect the second layer 134*a* facing away from the antenna elements 120*a* might be thicker than the second layer 134*b* facing the antenna elements 120*a*. This might enable improved protection from the physical environment surrounding the AAS 110*a*. That is, according to an embodiment, the second layer 134*b* facing the antenna elements 120*a* might be thinner than the other second layer 134*a*.

As disclosed above, the second layers 134*a*, 134*b* are of a second dielectric material. There might be different kinds of such second dielectric materials. In some aspects the second dielectric material is defined by its permittivity $\varepsilon_{r,2}$. In this respect the second dielectric material might have a permittivity $\varepsilon_{r,2}$, where $2.5\leq\varepsilon_{r,2}\leq5$. Preferably, $4\leq\varepsilon_{r,1}\leq4.7$.

Further, each of the second layers 134*a*, 134*b* could comprise several thin layers resulting in a total thickness $t_{2,1}$, $t_{2,2}$, and resulting permittivity $\varepsilon_{r,2}$. These thin layers could be of, or comprise, glass fiber fabric, high-modulus polyethylene (HMPE), adhesive layers, ultraviolet (UV) protection film, polyester, epoxy, surface coating, etc.

Figure 3:
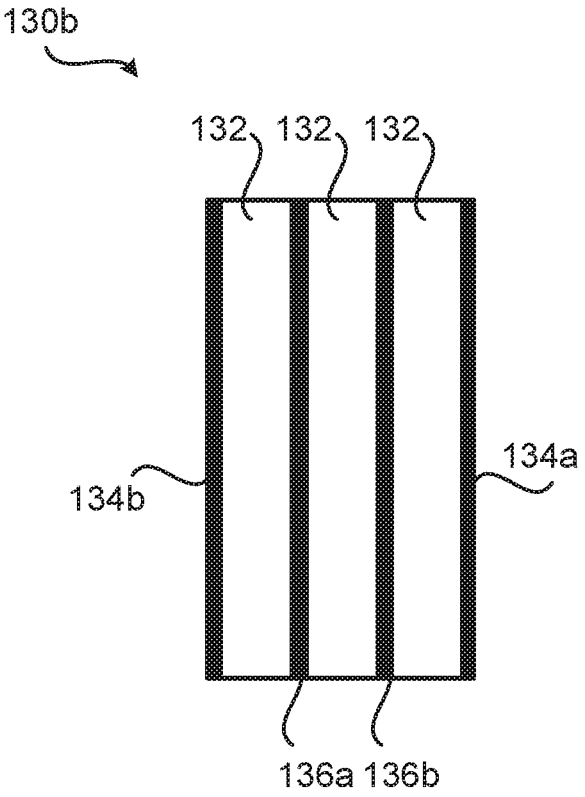
FIG. 3 schematically illustrates a radome according to an embodiment.

In some aspects the radome comprises at least one further layer. Reference is here made to FIG. 3 that schematically illustrates a radome 130*b* according to an embodiment. The radome 130*b* could replace the radome 130*a* in FIG. 2 and thus be combined with the AAS 110*a* in the combined antenna and radome arrangement 100*a*.

As for the radome 130*a*, the radome 130*b* has a first layer 132 with properties as disclosed above in terms of thickness and dielectric material. The first layer 132 is sandwiched between two second layers 134*a*, 134*b* with properties as disclosed above in terms of thickness and dielectric material. As above, a support structure might be disposed in the first layer 132.

The radome 130*b* of FIG. 3 further comprises at least one further layer 136*a*, 136*b*. Each of the at least one further layer 136*a*, 136*b* is disposed in the first layer 132. Each of the at least one further layer 136*a*, 136*b* is distanced from the second layers 134*a*, 134*b*. Each of the at least one further layer 136*a*, 136*b* is arranged in parallel with the second layers 134*a*, 134*b*.

In the illustrative example of FIG. 3, the radome 130*b* comprises two such further layers 136*a*, 136*b*. However, the radome 130*b* might be designed to, in principle, have any number of layers. In the illustrative example of FIG. 3, the distances between the second layers 134*a*, 134*b* and the further layers 136*a*, 136*b* are all the same. However, the further layers 136*a*, 136*b* need to be placed equidistant with respect to the second layers 134*a*, 134*b*.

Providing the radome 130*b* with further layers 136*a*, 136*b* might increase the mechanical strength of the radome 130*b*.

Aspects of the further layers 136*a*, 136*b* will now be disclosed.

In general terms, each further layer 136*a*, 136*b* has a thickness. In some aspects all further layers 136*a*, 136*b* are of the same thickness. Particularly, according to an embodiment, each of the at least one further layer 136*a*, 136*b* has a thickness in the range 0.1 mm to 0.5 mm. That is, each further layer 136*a*, 136*b* might have a thickness equal to the thickness of at least one of the second layers 134*a*, 134*b*. Having all second layers 134*a*, 134*b* and all further layers 136*a*, 136*b* of the same thickness simplifies production of these layers.

In general terms, each further layer 136*a*, 136*b* is of a dielectric material. There might be different kinds of such dielectric materials. In some aspects the dielectric material is defined by its permittivity. In some aspects each further layer 136*a*, 136*b* is of a dielectric material with the same permittivity as the second dielectric material. In particular, according to an embodiment, each of the at least one further layer 136*a*, 136*b* is of the second dielectric material.

Having all second layers 134*a*, 134*b* and all further layers 136*a*, 136*b* of the same dielectric material simplifies production of these layers.

In the roll-out of new frequency bands on existing mobile communication sites with legacy AAS (such as non-AAS) it is in many cases not possible to just add new equipment to the existing legacy antenna hardware. In fact, many existing mobile communication sites have restrictions on the number of hardware units allowed to be placed on the site. These restrictions might be driven by requirements that the mobile communication sites, and especially the antenna systems at the site, should be visually appealing. One way to accomplish this is to have a modular arrangement which is flexible to house antenna systems of different types, such as an AAS 110*a* and a non-AAS.

According to some aspects there is therefore provided a modular arrangement where an AAS (or other antenna system configured to operate in the frequency range 2.5 GHz to 10 GHz) is combined with a non-AAS (or other legacy antenna system configured to operate in the frequency range 0.6 GHz to 2.7 GHz) and covered by a common radome.

Hence, according to an embodiment the combined antenna and radome arrangement further comprises a non-AAS 110*b*. In this respect, the non-AAS 110*b* is a passive (legacy) antenna system. The non-AAS 110*b* comprises antenna elements 120*b*. The non-AAS 110*b* is configured for communication in a frequency range of 0.6-2.7 GHz.

The radome 130*a*, 130*b* is placed in front of the non-AAS 110*b* (and the AAS 110*a*) such that the radome 130*a*, 130*b* forms a common cover for the AAS 110*a* and the non-AAS 110*b*.

Figure 4:
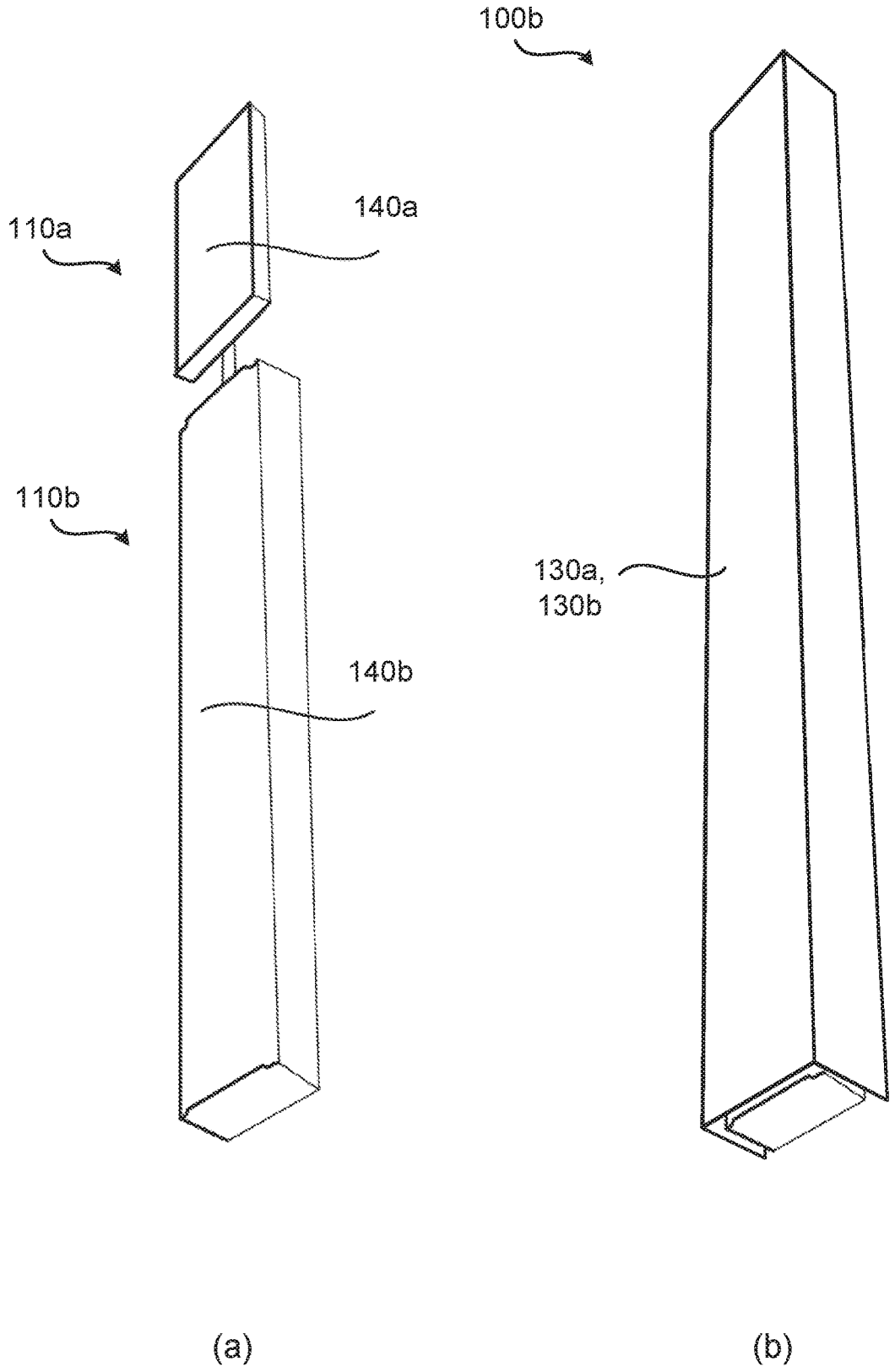
FIG. 4 schematically illustrates an AAS and a non-AAS, and a combined antenna and radome arrangement for the AAS and the non-AAS according to an embodiment.

FIG. 4(*a*) schematically illustrates an AAS 110*a* and a non-AAS 110*b*. FIG. 4(*b*) schematically illustrates a combined antenna and radome arrangement 100*b* for the AAS and the non-AAS according to an embodiment. In FIG. 4(*b*) the radome 130*a*, 130*b* is placed in front of the AAS 110*a* and the non-AAS 110*b* of FIG. 4(*a*) such that the radome 130*a*, 130*b* forms a common cover for the AAS 110*a* and the non-AAS 110*b*.

In the illustrative example of FIG. 4(*a*) the non-AAS 110*b* has its own inner radome 140*b*. This could be the case where the non-AAS 110*b* is provided as an off-the-shelf product. The inner radome 140*b* is placed in front of the antenna elements 120*b* of the non-AAS 110*b*. As in FIG. 4(*b*) the radome 130*a*, 130*b* then forms an outer radome for the non-AAS 110*b*.

Further, in the illustrative example of FIG. 4(*a*) also the AAS 110*a* has its own inner radome 140*a*. This could be the case where the AAS 110*a* is provided as an off-the-shelf product. The inner radome 140*a* is placed in front of the antenna elements 120*a* of the AAS 110*a*. As in FIG. 4(*b*) the radome 130*a*, 130*b* then forms an outer radome for the AAS 110*a*.

In the example of FIG. 4(*b*) the outer radome 130*a*, 130*b* is common for both the AAS 110*a* and the non-AAS 110*b*. It could be that the radome 130*a*, 130*b* takes the place of, and thus replaces, the inner radome 140*a* of the AAS 110*a*. This could be the case where the AAS 110*a* is not provided as an off-the-shelf product and represents the example illustrated in FIG. 2. In such a case the thus single radome of the AAS 110*a* might be extended to also cover the non-AAS 110*b* (which may or may not have its own inner radome 140*b*). Alternatively, the radome of the AAS 110*a* is not extended. A further radome is then provided on top of the radome of the AAS 110*a* to cover the AAS as well as the non-AAS 110*b*, as in FIG. 4(*b*).

There could be different ways to place the AAS 110*a* and the non-AAS 110*b* with respect to each other.

In some aspects the AAS 110*a* and the non-AAS 110*b* are placed to have the same general direction for transmission and reception. Particularly, according to an embodiment, the AAS 110*a* and the non-AAS 110*b* are placed such that the antenna elements 120*a* of the AAS 110*a* and the antenna elements 120*b* of the non-AAS 110*b* face the same direction. In this respect the face of the AAS 110*a* and the face of the non-AAS 110*b* where the antenna elements 120*a*, 120*b* are placed might thus face the same direction.

In some aspects the radome 130*a*, 130*b* is placed in front of the non-AAS 110*b* such that one of the second layers 134*a*, 134*b* faces the antenna elements 120*a* of the AAS 110*a* and the antenna elements 120*b* of the non-AAS 110*b*.

In the illustrative example of FIG. 4, the AAS 110*a* is placed on top of the non-AAS 110*b*. In other examples the non-AAS 110*b* might be placed on top of the AAS 110*a*. In yet other examples the AAS 110*a* and the non-AAS 110*b* are placed next to each other. In all these cases radome 130*a*, 130*b* is placed in front of the non-AAS 110*b* (and the AAS 110*b*) such that the radome 130*a*, 130*b* forms a common cover for the AAS 110*a* and the non-AAS 110*b*

In general terms, the radome 130*a*, 130*b* can be of any shape that enables the radome 130*a*, 130*b* to form a common cover for the AAS 110*a* and the non-AAS 110*b* and thus enables concealment of antenna systems at mobile communication sites. The following are examples of mobile communication site installations were the herein disclosed the radome 130*a*, 130*b* can be used to conceal antenna systems. The mobile communication site can be placed on top of buildings or on walls. The mobile communication site can be placed on top of information signs. The mobile communication site can be placed on top of electrical car charging stations. The mobile communication site can be placed on top of shelters at public transportation stops (such as bus stops or tram stops). The mobile communication site can be placed in a street environment.

Figure 5:
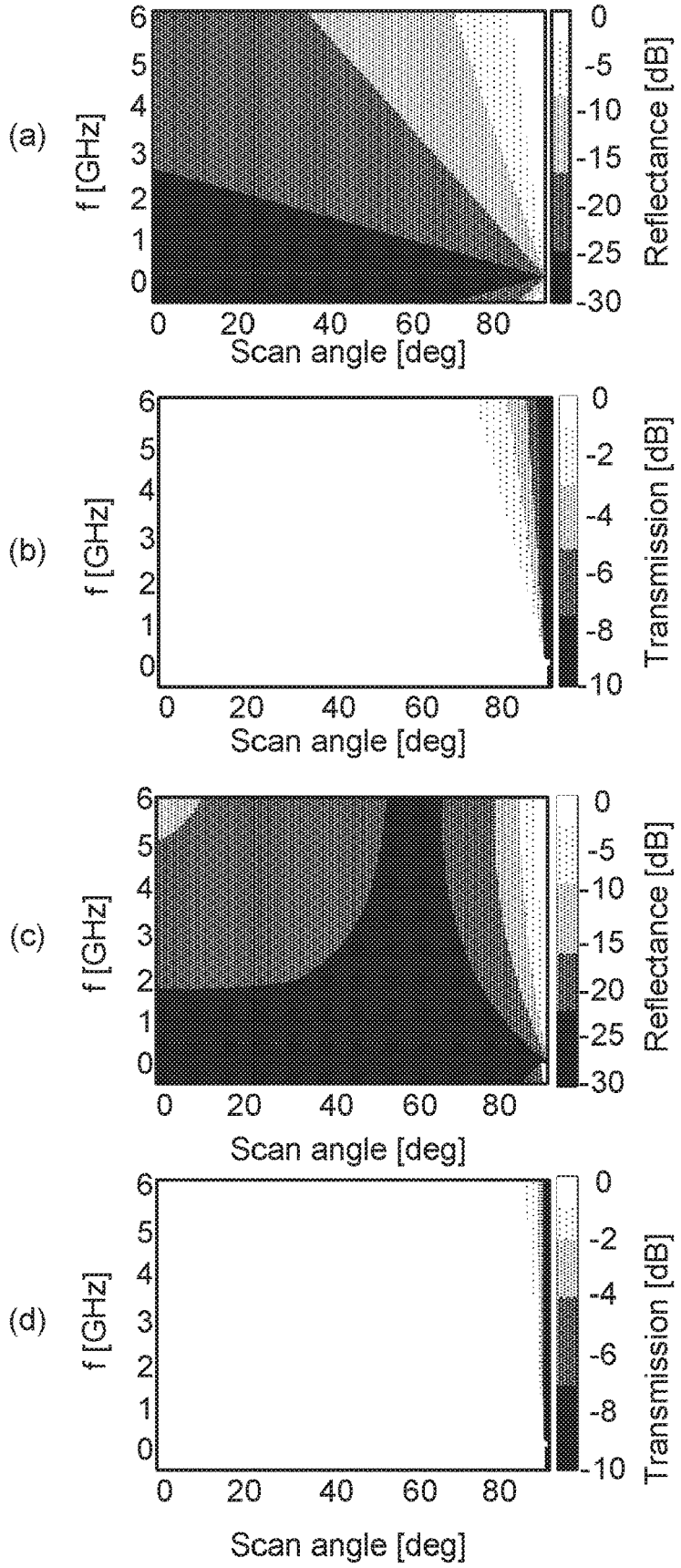
FIGS. 5, 6, 7, and 8 schematically illustrate predicted transmission and reflections properties for a radome according to embodiments.
Figure 6:
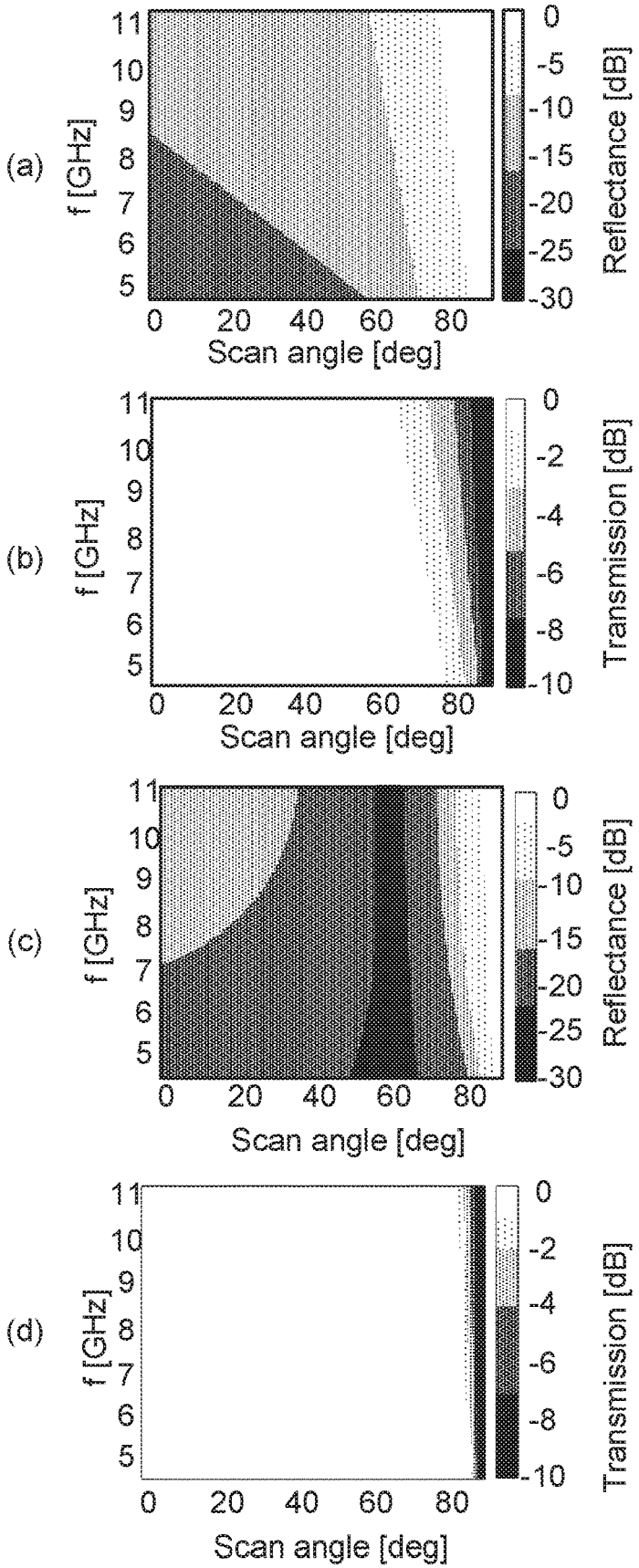

FIG. 5 and FIG. 6 show the predicted transmission and reflections properties for an example of the herein disclosed radome 130*a* as a function of frequency and illumination angle. At (a) and (b) are shown the results for an incident field with a polarization perpendicular to the plane of incidence while at (c) and (d) are shown the results for a polarization parallel to the plane of incidence. At (a) and (c) are shown the reflection properties and at (b) and (d) are shown the transmission properties of the radome.

Figure 1:
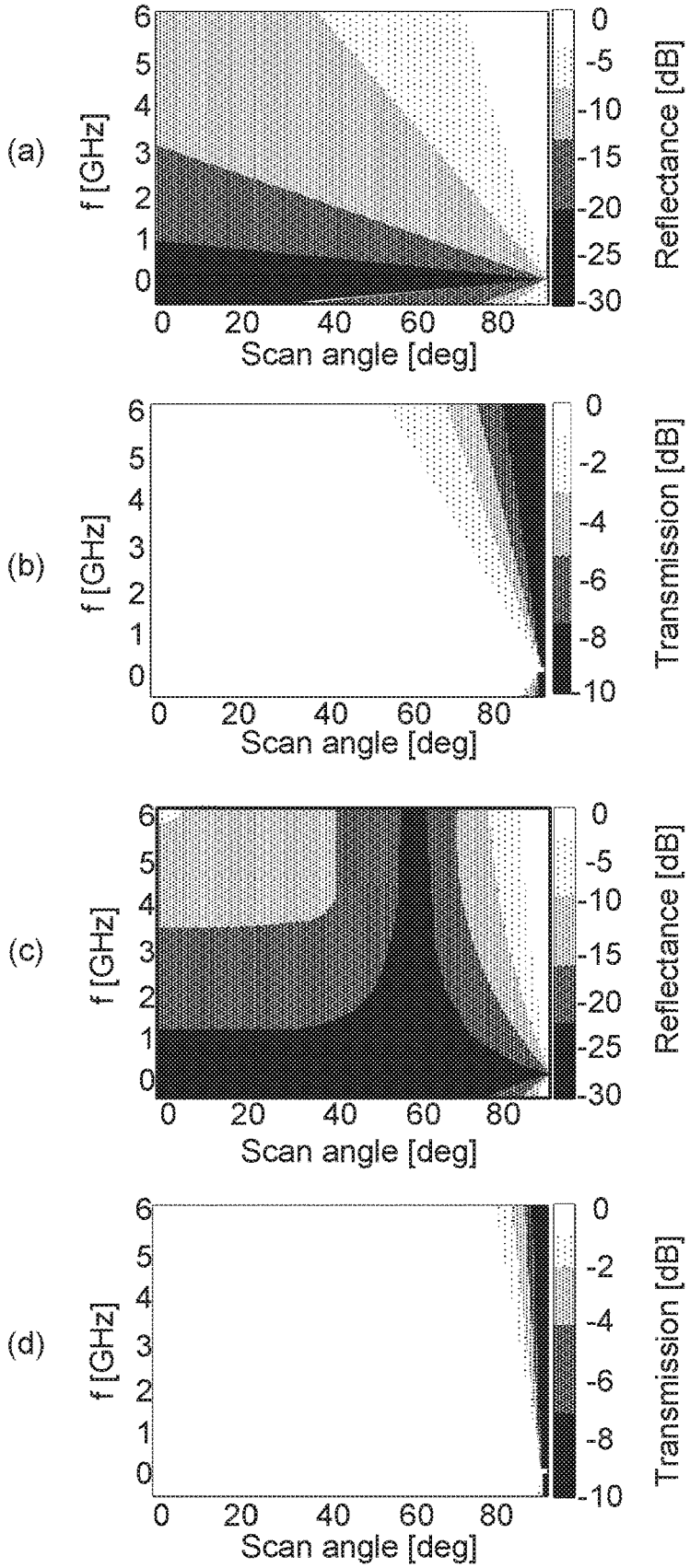
FIG. 1 schematically illustrates predicted transmission and reflections properties for a radome according to state of the art.

The radome 130*a* used for the results in FIG. 5 and FIG. 6 is electrically thin and consists of two second layers 134*a*, 134*b* each having a thickness $t_{2,1}$, $t_{2,2}$ of 0.3 mm and being of a second dielectric material with a permittivity $\varepsilon_{r,2}$=4.4, and a first layer 132 of a thickness $t_1$ of 2.5 mm and being of a first dielectric material with a permittivity $\varepsilon_{r,1}$=1.11. Comparing the results to FIG. 1, it is seen that the proposed radome 130*a* has significantly better RF performance than the legacy radome. Further, as can be seen in FIG. 5 and FIG. 6 the proposed radome 130*a* can be assumed to have a negligible impact on an AAS configured to operate up to frequencies well above 4.5 GHz.

Figure 7:
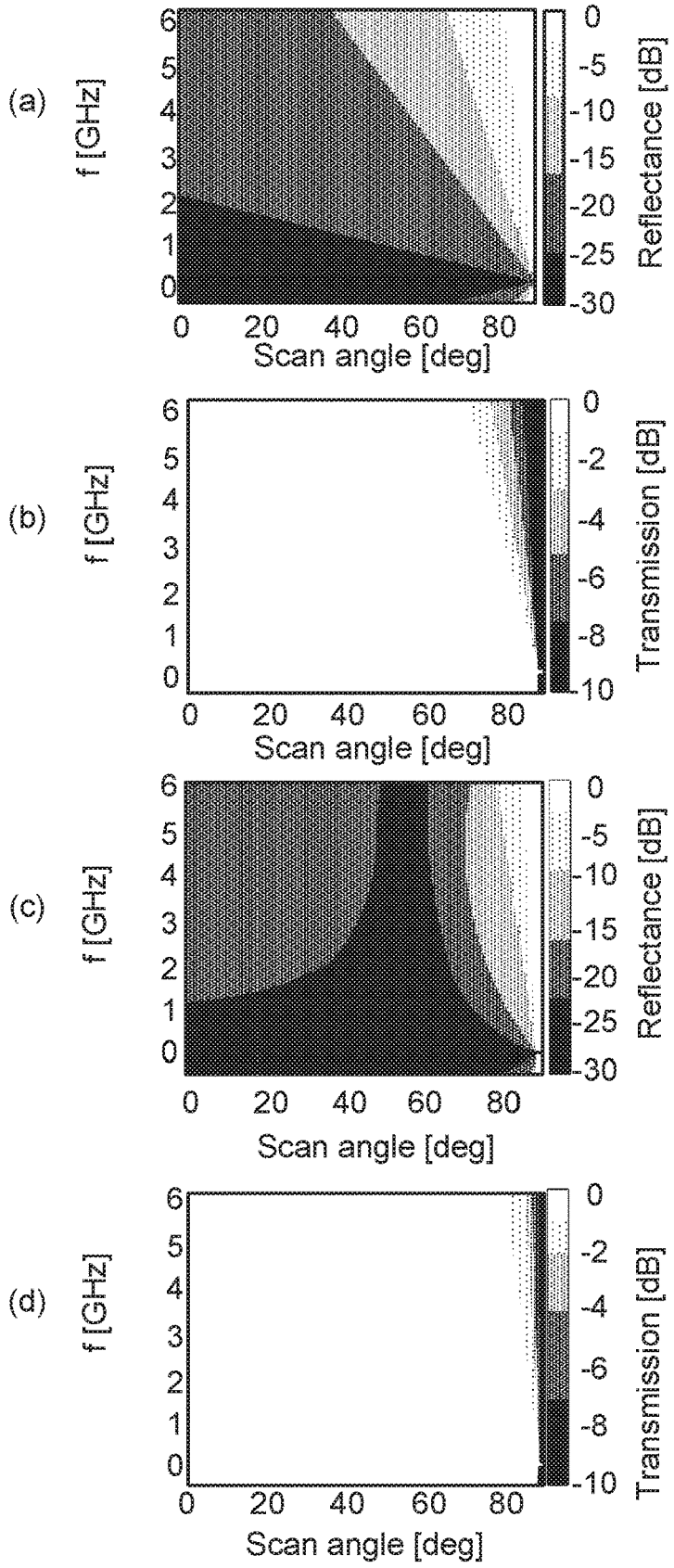
Figure 8:
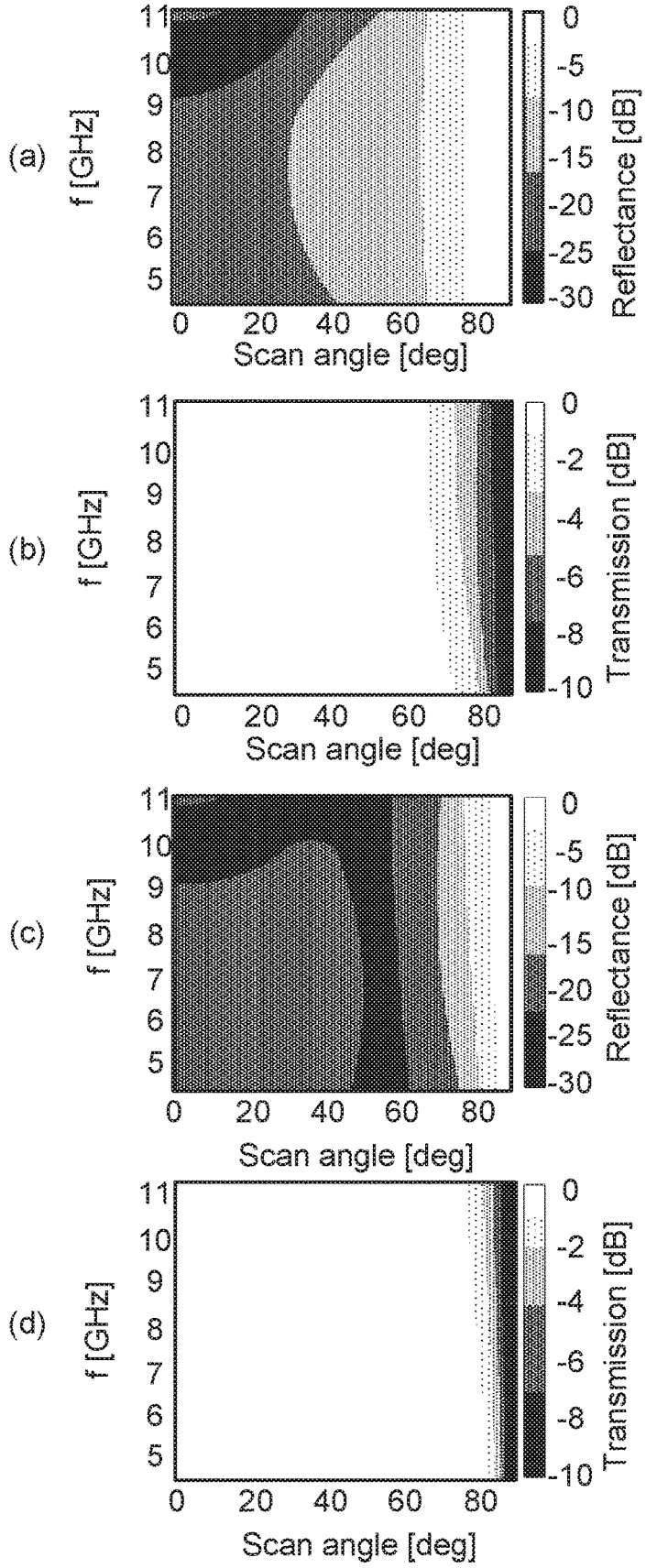

The performance in the frequency range 5 GHz to 10 GHz can be further improved by increasing the thickness of the first layer 132. FIG. 7 and FIG. 8 show the predicted transmission and reflections properties for another example of the herein disclosed radome 130*a* where the thickness $t_1$ of the first layer 132 is increased to 7.5 mm. In other respects the radome 130*a* as used for the results in FIG. 7 and FIG. 8 is identical to the one used for the results in FIG. 5 and FIG. 6. At (a) and (b) are shown the results for an incident field with a polarization perpendicular to the plane of incidence while at (c) and (d) are shown the results for a polarization parallel to the plane of incidence. At (a) and (c) are shown the reflection properties and at (b) and (d) are shown the transmission properties of the radome. Increasing the thickness $t_1$ of the first layer 132 to 7.5 mm implies that the thickness of the first layer 132 is in the order of quarter wavelengths at 10 GHz, whilst being electrically thin and untuned at the lower frequencies. Further, as can be seen in FIG. 7 and FIG. 8 the proposed radome 130*a* can be assumed to have a negligible impact on an AAS configured to operate up to frequencies up to 10 GHz.

Although the combined antenna and radome arrangements 110*a*, 100*b* have been described as comprising one AAS 110*a* (and, optionally, one non-AAS 110*b*), the combined antenna and radome arrangements 110*a*, 100*b* might generally comprise at least one AAS 110*a* (and, optionally, at least one non-AAS 110*b*) where the radome 130*a*, 130*b* is placed in front of each of the at least one AAS 110*a* (and, optionally, in front of each of the at least one non-AAS 110*b*) such that the radome 130*a*, 130*b* forms a cover for each of the at least one AAS 110*a* (and, optionally, for each one of the at least one non-AAS 110*b*). Hence, the radome 130*a*, 130*b* might form a common cover for at least two AASs of the same or different type, optionally combined with at least two non-AASs of the same or different type.

The AAS 110*a* and/or the non-AAS 110*b* might be part of a radio access network node, radio base station, base transceiver station, node B (NB), evolved node B (eNB), gNB, or access point.

The herein disclosed radome 130*a*, 130*b* can be cost efficiently manufactured using pultrusion production techniques.

The inventive concept has mainly been described above with reference to a few embodiments. However, as is readily appreciated by a person skilled in the art, other embodiments than the ones disclosed above are equally possible within the scope of the inventive concept, as defined by the appended patent claims.

The invention claimed is:

1. A combined antenna and radome apparatus, comprising:

an advanced antenna system (AAS) for transmitting signals to and receiving signals from at least one wireless communication device, the AAS comprising antenna elements and being configured for communication in a frequency range of 2.5 GHz to 10 GHz; and a radome, the radome having a first layer positioned between two second layers, the two second layers being of a second dielectric material, and the first layer being of a first dielectric material and having a thickness t1, where t1≤λmin/3, wherein λmin is the wavelength of the highest frequency in the frequency range of the AAS, wherein the radome is placed in front of the AAS such that the radome forms a cover for the AAS.

2. The apparatus according to claim 1, wherein the radome is placed in front of the AAS such that one of the second layers faces the antenna elements of the AAS.

3. The apparatus according to claim 1, wherein t1>1.5 mm.

4. The apparatus according to claim 1, wherein t1≤λmin/4.

5. The apparatus according to claim 1, wherein the first dielectric material has a permittivity εr,1, where 1≤εr,1≤1.5, preferably 1.05≤εr,1≤1.2.

6. The apparatus according to claim 1, wherein the second dielectric material has a permittivity εr,2, where 2.5≤εr,2≤5, preferably 4≤εr,1≤4.7.

7. The apparatus according to claim 1, wherein each second layer has a thickness t2,1, t2,2 in the range 0.1 mm to 0.5 mm.

8. The apparatus according to claim 2, wherein the second layer facing the antenna elements is thinner than the other second layer.

9. The apparatus according to claim 1, wherein the radome further comprises:

at last one further layer, the at least one further layer being disposed in the first layer, distanced from the second layers, and arranged in parallel with the second layers.

10. The apparatus according to claim 9, wherein each of the at least one further layer has a thickness in the range 0.1 mm to 0.5 mm.

11. The apparatus according to claim 9, wherein each of the at least one further layer is of the second dielectric material.

12. The apparatus according to claim 1, wherein the radome further comprises:

a support structure disposed in the in the first layer.

13. The apparatus according to claim 12, wherein the support structure has the geometry of a honeycomb.

14. The apparatus according to claim 1, wherein the first dielectric material is a solid foam with closed or open cells, such as a Polymethacrylimide, PMI, foam.

15. The apparatus according to claim 1, further comprising:

a non-advanced antenna system, non-AAS, the non-AAS comprising antenna elements and being configured for communication in a frequency range of 0.6-2.7 GHz, and wherein the radome is placed in front of the non-AAS such that the radome forms a common cover for the AAS and the non-AAS.

16. The apparatus according to claim 15, wherein the AAS and the non-AAS are placed such that the antenna elements of the AAS and the antenna elements of the non-AAS face the same direction.

17. The apparatus according to claim 15, wherein the radome is placed in front of the non-AAS such that one of the second layers faces the antenna elements of the AAS and the antenna elements of the non-AAS.

18. The apparatus according to claim 15, wherein the radome is an outer radome, wherein the non-AAS further comprises an inner radome placed in front of the antenna elements of the non-AAS.

19. The apparatus according to claim 15, wherein the radome is an outer radome, wherein the AAS further comprises an inner radome placed in front of the antenna elements of the AAS.

20. A communication system, the communication system comprising:

an antenna configured to be connected to a radio access network (RAN) node within a RAN for employing the antenna to transmit signals to and receive signals from at least one wireless communication device; and a radome comprising a first layer disposed between a second layer and a third layer, wherein the first layer comprises a first dielectric material and has a thickness of less than 30 millimeters (mm), the second layer comprises a second dielectric, the third layer comprises the second dielectric, and the radome is placed in front of the antenna such that the radome forms a cover for the antenna.

* * * * *